US005586936A

United States Patent [19]

Bennett et al.

[11] Patent Number: 5,586,936

[45] Date of Patent: Dec. 24, 1996

[54] AUTOMATED GAMING TABLE TRACKING SYSTEM AND METHOD THEREFOR

[75] Inventors: Michael J. Bennett, Las Vegas; John E. Nino; Brian D. Todoroff, both of Henderson, all of Nev.

[73] Assignee: Mikohn Gaming Corporation, Las Vegas, Nev.

[21] Appl. No.: 310,718

[22] Filed: Sep. 22, 1994

[51] Int. Cl.[6] ..... A63F 1/18

[52] U.S. Cl. ..... 463/25; 463/42

[58] Field of Search ..... 273/309, 138 A, 273/143 R, 292, 85 CP; 463/11, 25, 29, 42

[56] References Cited

U.S. PATENT DOCUMENTS

| | | | |
|---|---|---|---|
| 4,339,798 | 7/1982 | Hedges et al. | 273/138 A |
| 4,755,941 | 7/1988 | Bacchi | 273/138 A |
| 4,813,675 | 3/1989 | Greenwood | 273/138 A |
| 5,321,241 | 6/1994 | Craine | 273/138 A |
| 5,364,104 | 11/1994 | Jones et al. | 273/292 |
| 5,377,994 | 1/1995 | Jones | 273/309 |
| 5,393,067 | 2/1995 | Paulsen et al. | 273/292 |
| 5,429,361 | 7/1995 | Raven et al. | 463/25 |
| 5,470,079 | 11/1995 | LeStrange et al. | 463/25 |

*Primary Examiner*—Jessica Harrison
*Assistant Examiner*—Jaes Schaaf
*Attorney, Agent, or Firm*—Dorr, Carson, Sloan & Birney, PC

[57] ABSTRACT

An automated gaming table tracking system for a gaming table, such as blackjack. A sensor located in the dealer's card playing area senses the start and end of each game. A unique player identity card is given to each player that contains information on the player. When a player arrives at a player position on the table, the player inserts his player identity card into a player station control at the player position. A central distribution control is connected to each player station control for determining the start and the end of each game and beginning and termination of play by each player at each position. A host computer of the present invention is then interconnected to the central distribution control for storing the player identity information and the player position for each player station control, the start and end of each of the games, and the beginning and termination of play at each player position from the central distribution control. The host computer prints a player tracking card. The floor supervisor observes the player during the game and fills out the in-session gaming information. Once the player leaves the table, the player tracking card with the in-session gaming information filled out is then placed in an automatic reader so that the read in-session gaming information is stored in a data base corresponding to the identity of the player.

19 Claims, 11 Drawing Sheets

10
20a
30
20b
20c
300
140
120
100
50
60
130
70
20d
30
20e
40
110b
500
20f
20g
90
500
80
900
110
110a
882

AUTOMATED GAMING TABLE TRACKING SYSTEM AND METHOD THEREFOR

FIELD OF THE INVENTION

The present invention relates to automated gaming equipment and, more particularly, to an automated gaming table system and method therefor for tracking players, dealers, and games occurring at the automated table.

STATEMENT OF THE PROBLEM

A need exists to track live player interaction at a gaming table. Historically, dealers and floor supervisors would remember frequent players and the players' gambling habits. For example, if a particular frequent player over time lost money to the casino, the player may receive complimentary gifts from the casino such as free rooms, food, travel, and so forth.

Presently, tracking cards are utilized by the floor supervisors to accumulate information on a particular player's progress. When a player sits down at a table, the floor supervisor recognizes the player and fills out the player's name, account number, date, and identity of the table. The tracking cards contain the following information: the identity of the game, the approximate start time that the player first sat at the table and the end time that the player left, the total buy-in at the table, the player's minimum bet, the player's maximum bet, as well as his average bet, an overall estimated win, loss, or even determination, and an estimate as to how much money was won or lost. Finally, the floor supervisor's identity is usually filled in. This information is typically entered onto the tracking card in a form that can be machine-read. Unfortunately, while the tracking card works well with several players, it is wholly inadequate to monitor a number of players, especially when the floor supervisor is responsible for three, four, or five tables. Each table may have 7 players, and with 5 tables, the supervisor must monitor up to 35 players who randomly come and go from a game.

A need, therefore, exists to highly automate the procedure of tracking a player at a gaming table from the point in time the player sits at the gaming table to when the player leaves the gaming table, to accurately monitor the number of games the player played in, and to automatically print out a tracking card already containing the identity of the player for use by the floor supervisor.

A further need exists for casino operators to carefully monitor the number of hands per hour played by their own dealers playing the game. Again, presently the floor supervisor manually observes how many games a dealer deals in an hour. The more games per hour that the dealer can deal, the more profit a casino can enjoy.

SOLUTION TO THE PROBLEM

The present invention provides a solution to the above two problems by providing an automated gaming table tracking system and method therefor which carefully monitors each player when he first starts a game and when he leaves or terminates a game. As soon as a player arrives in a game, the system of the present invention senses the player, identifies the table and the position that the player sits at the table, and prints out a "tracking card" that contains a substantial amount of information for use by the floor supervisor thereby eliminating the time needed for the supervisor to manually fill out this information.

The operation of the system of the present invention begins with the player inserting a unique player identity card into a magnetic stripe reader mounted on the armrest of the table located at his position. The data on the player's card is then delivered to a computer located on the gaming table. The computer keeps track of the start of game information for the player and prints the player's tracking card for use by the floor supervisor. The start of game information is tracked by a photosensitive device that is activated when the dealer puts his cards over the device so that light will not enter it while the game is being played. The sensitivity of the light-sensitive device is fully adjustable so casinos with varying indoor light intensities can be accommodated.

When the player inserts his card into the magnetic reader, the computer inserts a new record into the player's data base, which contains the player's account number, start time, table, game, position, and the identity of the floor supervisor—all data pertinent to tracking a player except in-session monetary values. The host computer then causes a "tracking card" to be printed out with a thermal printer. The tracking card contains all the player's tracking information, data spots for the supervisor to fill in monetary tracking information, and a unique serial number for that card. As the player is playing, the floor supervisor tracks his play. When the player is finished playing, the player removes the player's tracking card and the information is again sent to the computer where the player's data base record is updated to indicate his end time and the number of hands he played. At this time, the supervisor marks the spots indicating the player's betting amounts and the card is fed through the reader and the player's record appears on the screen. If there is any data that is required to be updated such as, for example, the supervisor forgot to mark a field, the supervisor will be informed of the error and will be able to change any data he feels is incorrect. Once this data is complete, the data is updated in the data base. The data from the host computer is then sent to a remote computer to be combined with other data concerning the player.

The present invention also determines the number of games per hour (or other suitable parameter) that the dealer deals by counting the number of games dealt by the dealer with the photosensitive device. The present invention also determines when the dealer commences to deal and stops dealing.

SUMMARY OF THE INVENTION

An automated gaming table tracking system for a gaming table adapted for and on which is played a number of games of a predetermined type, such as blackjack. The gaming table is conventional having: a playing surface, a plurality of player positions, a dealer position, and defined game playing areas for the dealer and each of the players. The system of the present invention includes a sensor located in the dealer's playing area for sensing the presence of a gaming device such as a game card. A unique player identity card is given to each player that contains information on the player such as an identification number, the players name and address, the business the player works for, and so forth. At each player position is a player station control. When a player arrives at a player position, the player inserts his player identity card into the player station control and leaves it inserted. The player identity card is read to receive the identity information corresponding to the player.

The player station control includes a magnetic card reader, a circuit for identifying the player position on the table, a digital display for displaying a plurality of predetermined messages to the player, and a visual light indicating that the card is inserted into the magnetic card reader. A central processing unit is connected to the aforesaid components of the player station control that controls the operations of these components and is further connected to an external communication port for delivery of data, including the player identity information, externally from the player station control.

A central distribution control is connected to each player station control. The central distribution control has a circuit for identifying the gaming table. It is also connected to the sensor and receives signals from the sensor when the dealer places a game card over the sensor indicating the start of a game. When the game card is removed from the sensor for a predetermined period of time, the end of the game is sensed. The central distribution control is also connected to the external communication port of each player station control to receive the player identity information and the identity of the player station control. The central distribution control determines the start and the end of each game and beginning and termination of play by each player at each position.

A host computer of the present invention is then interconnected to the central distribution control for storing the player identity information and the player position for each player station control, the start and end of each of the games, and the beginning and termination of play at each player position from the central distribution control. The host computer prints a player tracking card for each player position having a player identity card inserted into the reader. The floor supervisor observes the player during the game and fills out the in-session gaming information required by the player tracker card, such as cash brought to the table, betting information, cash when leaving the table, and whether the player won, lost, or broke even. Once the player leaves the table, the player tracking card with the in-session gaming information filled out is then placed in an automatic reader so that the read in-session gaming information is stored in a data base corresponding to the identity of the player. Hence, all relevant information concerning the activities of the player at the gaming table is automatically stored.

DESCRIPTION OF THE DRAWING

FIG. 7(*b*) sets forth the details of the communications port.

DETAILED SPECIFICATION

1. Gaming Table

Figure 1:
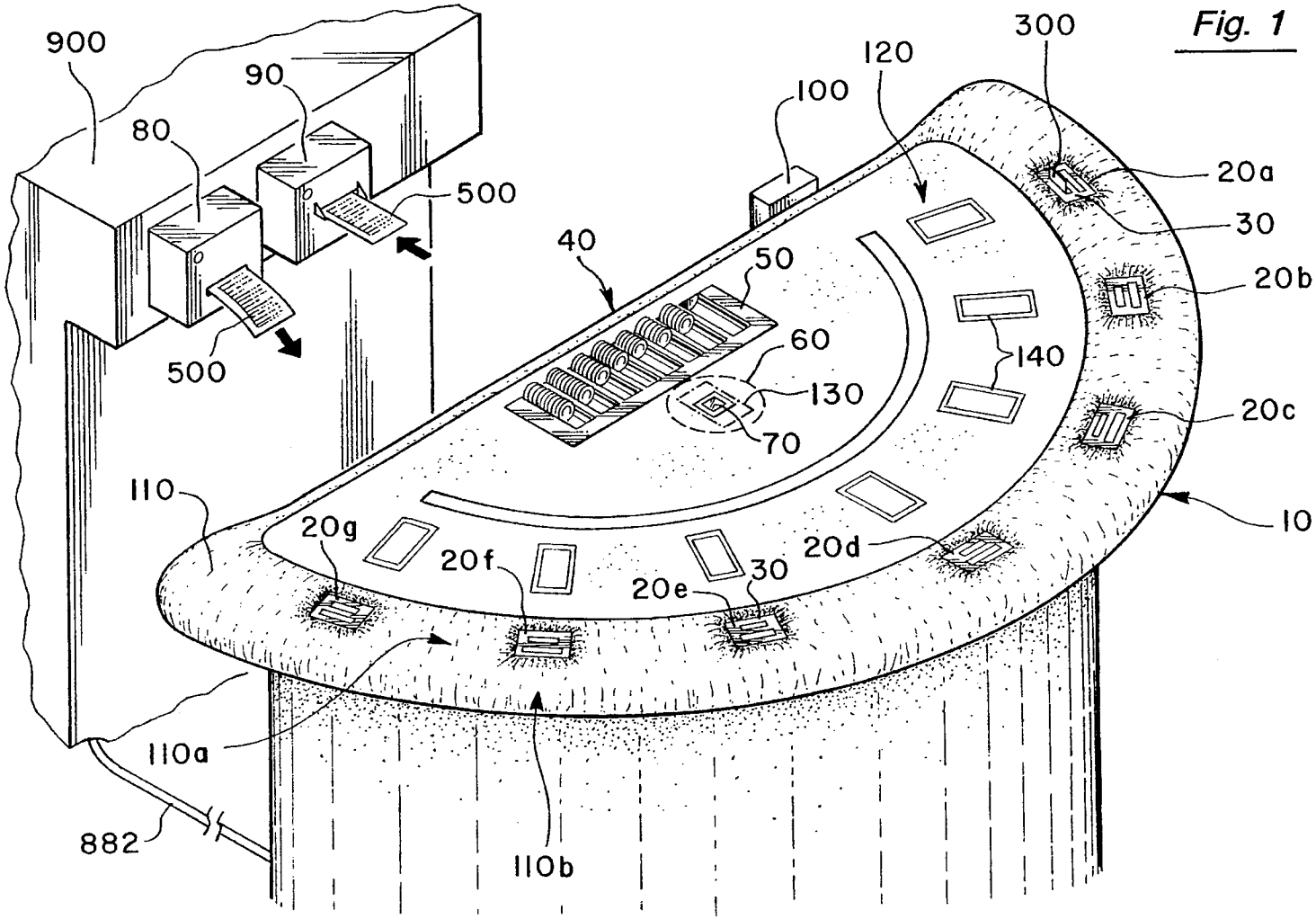
FIG. 1 is a perspective view illustrating an automated gaming tracking table of the present invention interconnected to a host computer.

In FIG. 1, a conventional gaming table 10 is shown that is used to play games such as any conventional card game. For example, blackjack could be played at this table. The table 10 has seven player positions 20*a* through 20*g*. Each player position 20 has a player station 30. It is to be expressly understood that the gaming table 10 can have any suitable number of player positions 20, each with corresponding player stations 30. In the embodiment shown in FIG. 1, the player positions 20*a* through 20*g* form an arc about the dealer position generally represented by arrow 40. Any number of player positions could be provided depending on the game. Directly in front of the dealer is a conventional coin tray 50. Directly in front of the coin tray 50 is an area designated by lines 60 that represent the card playing area for the dealer. A game sensor 70 of the present invention is located centrally in area 60. The sensor 70 automatically senses the start and end of each card game.

Mounted near the table 10 is a thermal printer 80 for printing player tracking cards 500 and a reader 90 for reading filled-out player tracking cards 500. This is illustrated at location 900, which is the host computer. The electronics in the table 10 communicate with a host computer 900 over cable 882. A magnetic stripe reader 100 is also located on the gaming table 10 near the dealer's position 40 for reading the dealer's identity card, as well as reading the floor supervisor's identity card. Under the teachings of the present invention, the tracking card printer 80, the tracking card reader 90, and the magnetic card reader 100 can be located either individually at the table 10 or at a remote location near the table 10. For example, it may be desirable to have a single floor supervisor monitor five tables 10 and, therefore, have the printer 80, the reader 90, and the magnetic card reader 100 located in a more central location to the five tables. The present invention is not limited by the location of the input and output devices 80, 90, and 100.

The table 10 as shown in FIG. 1 is a conventional table with a heavily padded armrest 110 and a felt pad playing area 120. Each player's station 30 is retrofitted into the padded area 110 as shown in FIG. 1. While the presence of these player stations may provide a minor inconvenience to each player, the overall value to the casino is enormous. Furthermore, each player station 30 must be fully operational in adverse conditions such as spilled drinks, dropped ashes from cigarettes, and so forth.

In front of each player position 20 are individual game card-playing areas 140. The present invention is not limited to card games and the system of the preferred embodiment could be adapted for other games, such as craps.

When a player sits down such as at position 20*a*, the player inserts a magnetic card 300 into the player station 30. The system of the present invention, as will be subsequently explained, reads the magnetic stripe on the card and prints a tracking card 500 with thermal printer 80.

In a typical game of blackjack, the dealer deals the first game card to position 20*a* and then sequentially deals a game card, not shown, to each player position having a player playing the game. The dealer then receives his first game card, which he places over the game sensor 70 as shown by dotted line 130. When game card 130 is placed over sensor 70, it triggers a start of game signal.

When a game is finished, the dealer removes the game card 130 from over the game sensor 70. A period of time elapses before the start of the next game when the dealer repeats the process. When the player leaves the player position 20*a*, the player removes his player identity card 300, which is sensed by the system of the present invention.

The floor supervisor then fills out the player's tracking card 500 with in-session gaming information and inserts it into the reader 90, as will be subsequently discussed. All information (e.g., player information, game times, in-session gaming information) concerning the player at position 20*a* at table 10 has now been delivered to the host computer 900.

Likewise, the dealer can be tracked since the dealer inserts his magnetic card into reader 100 at the start of dealing and upon leaving dealing removes the card. Hence, the number of games dealt per hour can be accurately monitored for that particular dealer, as well as when the dealer arrived at the table 10 and left.

The details of the present invention follow and it is to be expressly understood that while a preferred embodiment is disclosed, variations to the disclosed embodiment could be made that would still fall within the teachings of the present invention as set forth in the claims appended hereto.

2. Player Station

Figure 2:
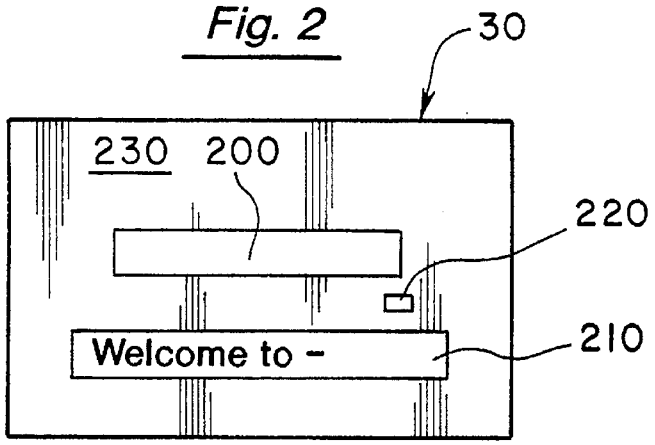
FIG. 2 sets forth the top plane view of a player station of the present invention.

As shown in FIG. 2, each player station 30 includes a magnetic card reader 200, a digital display 210, and a two-color LED 220. The face plate 230 of the player station 30 is typically rectangular in shape and fiat, although it is to be expressly understood that any suitable shape and configuration could be used for plate 230. The player station 30 functions to serve as a reader and a display. This will be discussed subsequently.

It is to be expressly understood that under the teachings of the present invention, the player station 30 is located on the substantially horizontal region 110*a* (shown in FIG. 1) of the armrest. However, each player station 30 could also be located on the side wall 110*b* of the armrest. It is desirable for the dealer at position 40 to view the slot and in the event a player leaves the table, to remind the player to remove his player identity card.

Figure 3A:
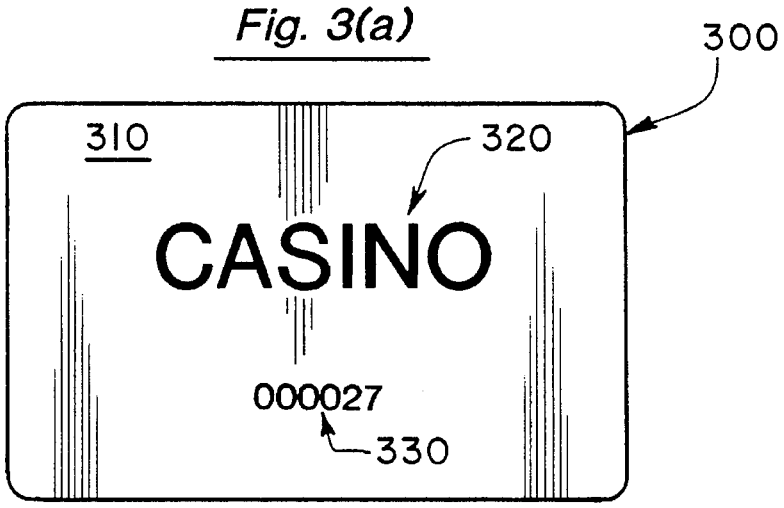
FIG. 3(*a*) and FIG. 3(*b*) set forth the front and back plane views of a player identity card, dealer card, and floor supervisor card of the present invention.
Figure 3B:
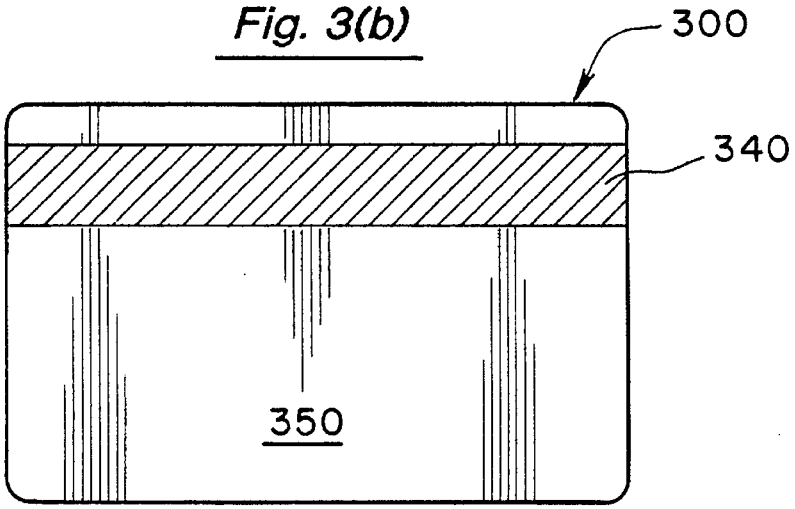

3. Player Identity Card, Dealer Identity Card, and Floor Supervisor Identity Card The player, dealer, and floor supervisor identity cards can be somewhat similar and of the type shown in FIGS. 3(*a*) and 3(*b*). On the front face 310, the name of the casino 320 is printed. The player identity, dealer identity, or floor supervisor identity 330 can be embossed on the card 300. On the rear face 350 of the card 300 is a magnetic stripe 340 that contains any desirable information, such as the player's name, address, account number, etc., of the owner of the player identity card.

In the preferred embodiment, the player identity card 300 is credit card size and is preferably 2-⅛ inch by 3-⅜ inch. It is to be understood that any configuration for the player identity card 300 could be used and that other information other than the casino's name 320 and the player's identification number 330 could be placed on the card. The player identity card 300 is made of suitable, durable plastic material.

It is to be expressly understood that any suitable document can be utilized carrying this type of information.

Figure 4:
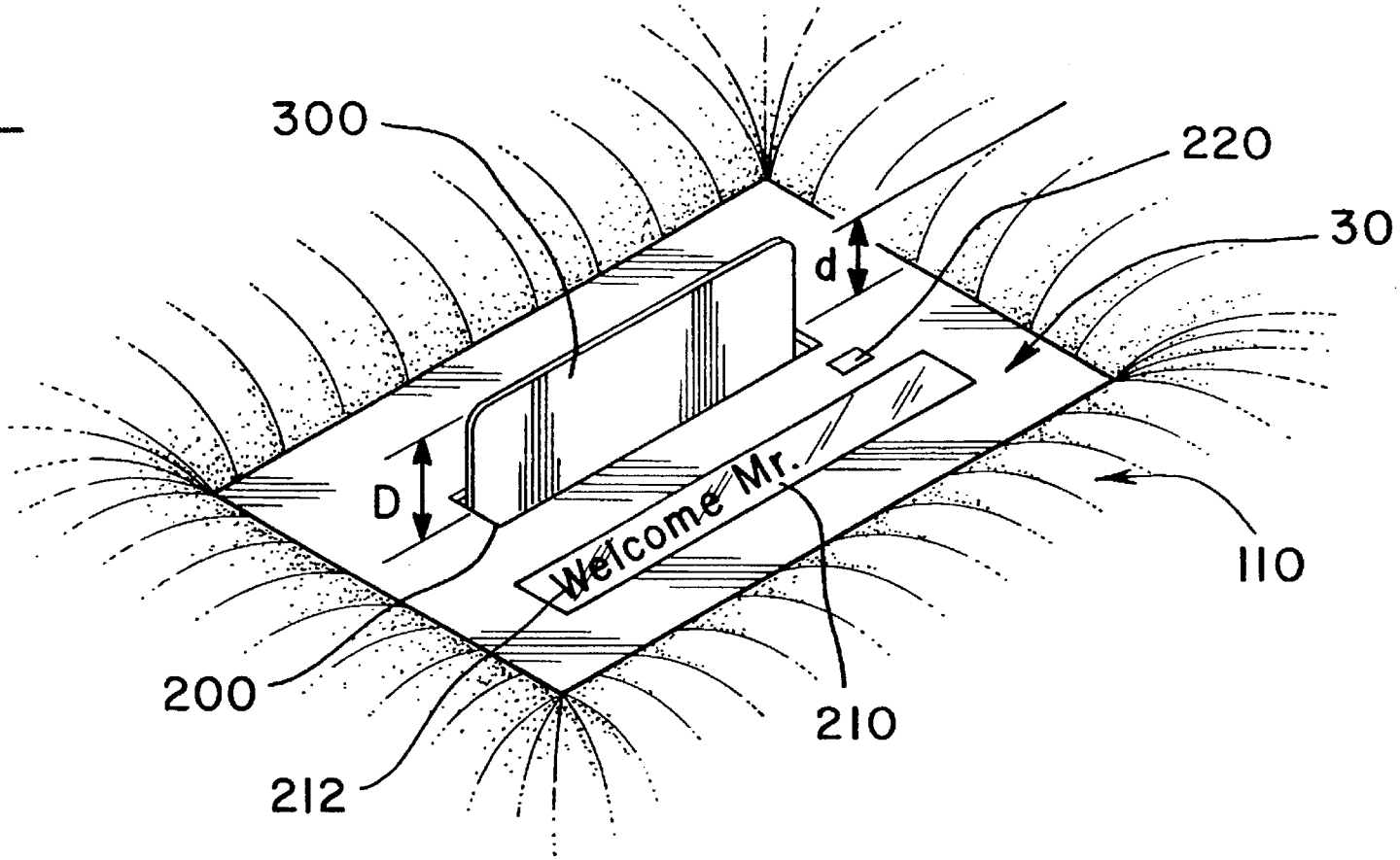
FIG. 4 sets forth a perspective view illustrating a player identity card fully inserted into a player station of the present invention.

In FIG. 4, the player identity card 300 is shown inserted into a player station 30 that is slightly embedded into the padded armrest 110. In the preferred embodiment, the plate 30 is embedded a distance "d" from the upper surface of the padded armrest 110. The player identity card 300 when fully inserted extends above the plate 30 a distance "D." Under the teachings of the present invention, "D" is greater than "d." Typically, the values of both distances are in the range of ⅛ inch to ½ inch. With this preferred range of distances, when the player identity card is inserted into the player station 30, it remains there as long as the player sits at the position. When the player decides to leave, the player removes the player identity card 300 from the reader 200. Hence, while the player is playing a game, the player identity card 300 remains fully inserted into the reader 200, and due to the recessed nature of the station 30 with respect to the padded armrest 110, it does not pose an annoyance to the player.

4. Player Tracking Card

Figure 5A:
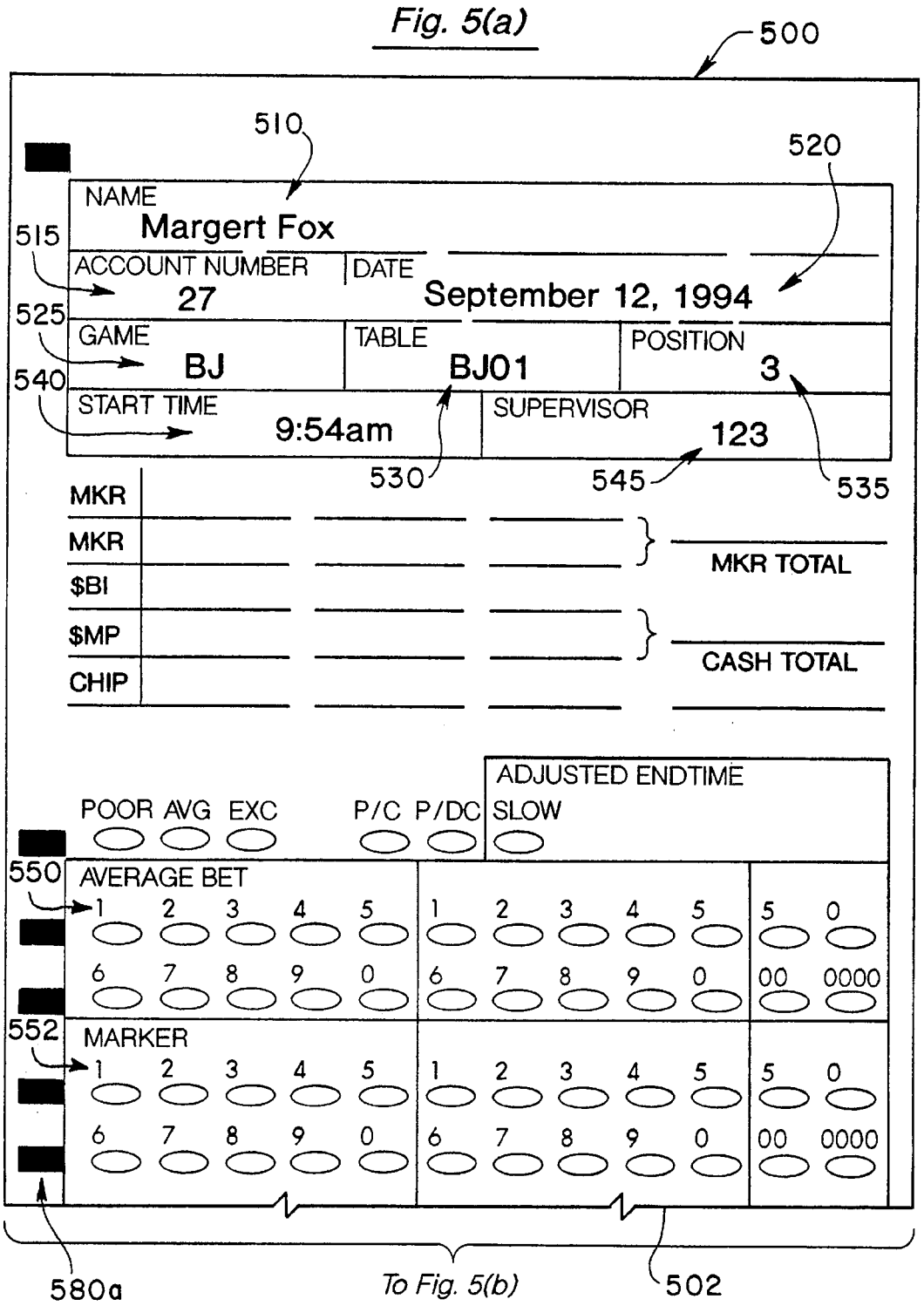
FIG. 5(*a*) and FIG. 5(*b*) set forth a player tracking card of the present invention.
Figure 5B:
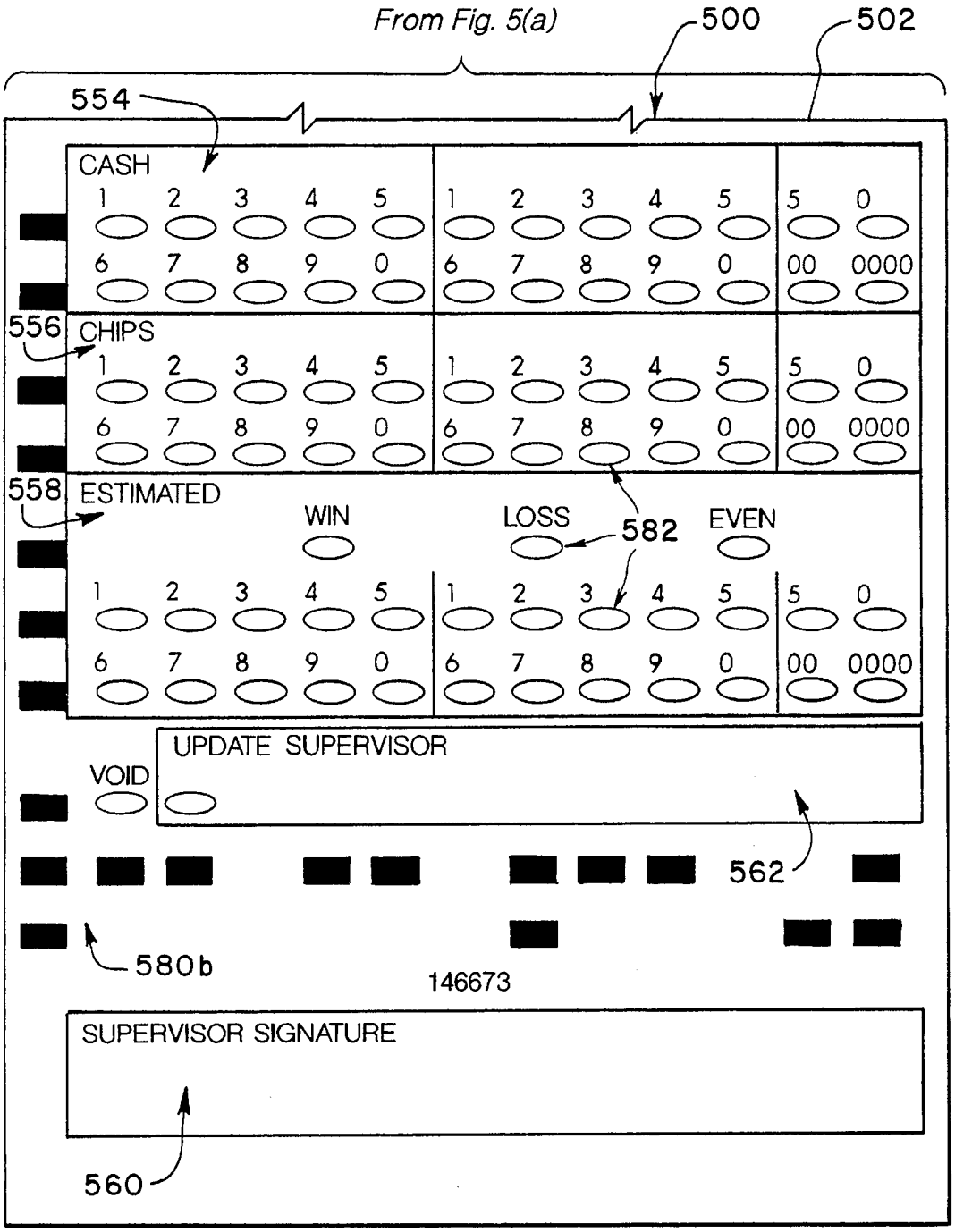

The player tracking card 500 is illustrated in FIGS. 5(*a*) and 5(*b*). The player tracking card 500 is unitary and FIGS. 5(*a*) and 5(*b*) are split along common edge 502 for illustration purposes only. This is a player tracking card of the preferred embodiment. This player tracking card 500 is printed by the thermal printer 80 (FIG. 1 ) after a player inserts a player identity card 300 into a player station 30. The thermal printer could, for example, be a Zebra Technologies Corp. Model Z-105.

As shown in FIG. 5(*a*), when a player inserts the player identity card 500 into a station 30, the players name 510 is printed on the player tracking card 500, the player's account number 515 is printed, the date 520 is printed, the identity of the game 525 is printed, the identity of the table 530 is printed, the player's position at the table is printed 535, the player's start time (i.e., the time the player inserted the card) 540 is printed, and the supervisor's identity 545 is printed. The dealer's name can also be optionally printed. It is to be understood that the thermal printer can print the entire player tracking card, including the information on the player, or simply print the player's information on a pre-printed player tracking card.

All of the player's information is automatically printed on the player tracking card 500 based on the information in the magnetic card stripe 340 of the player identity card 300. The floor supervisor then picks up the printed player tracking card 500 from the printer 80 and, as the player plays the game, observes the player. When the player leaves the game table 10 and removes the magnetic player identity card 300 from the station 30, the floor supervisor then fills out the remaining dynamic player rating information (termed in-session gaming information) on the player tracking card such as the buy-in amount, minimum bet, maximum bet, average bet 550, the marker 552, the cash information 554, the chips 556, and the estimated performance (i.e., win, loss, even) of the player 558. The floor supervisor then signs 560 the player tracking card.

A unique identity code, such as a sequence number, is printed as blackened-in boxes along the side and is generally shown as 580*a* and 580*b*. Each player tracking card 500 has its own unique identity code that is assigned to the actual player. When the player tracking card 500 is completely filled out by selectively blackening-in the ovals 582, which generally occurs after the player leaves the gaming table, the floor supervisor inserts the player tracking card 500 into a reader 90 that reads, with a conventional optical mark-sense reader, the in-session gaming information in the encircled ovals and further reads the unique identity code 580*a* and 580*b* so that the in-session gaming information contained on this card can be correlated to the particular player based on the unique identity code 580*a* and 580*b*.

5. Player Station Control

Figure 6:
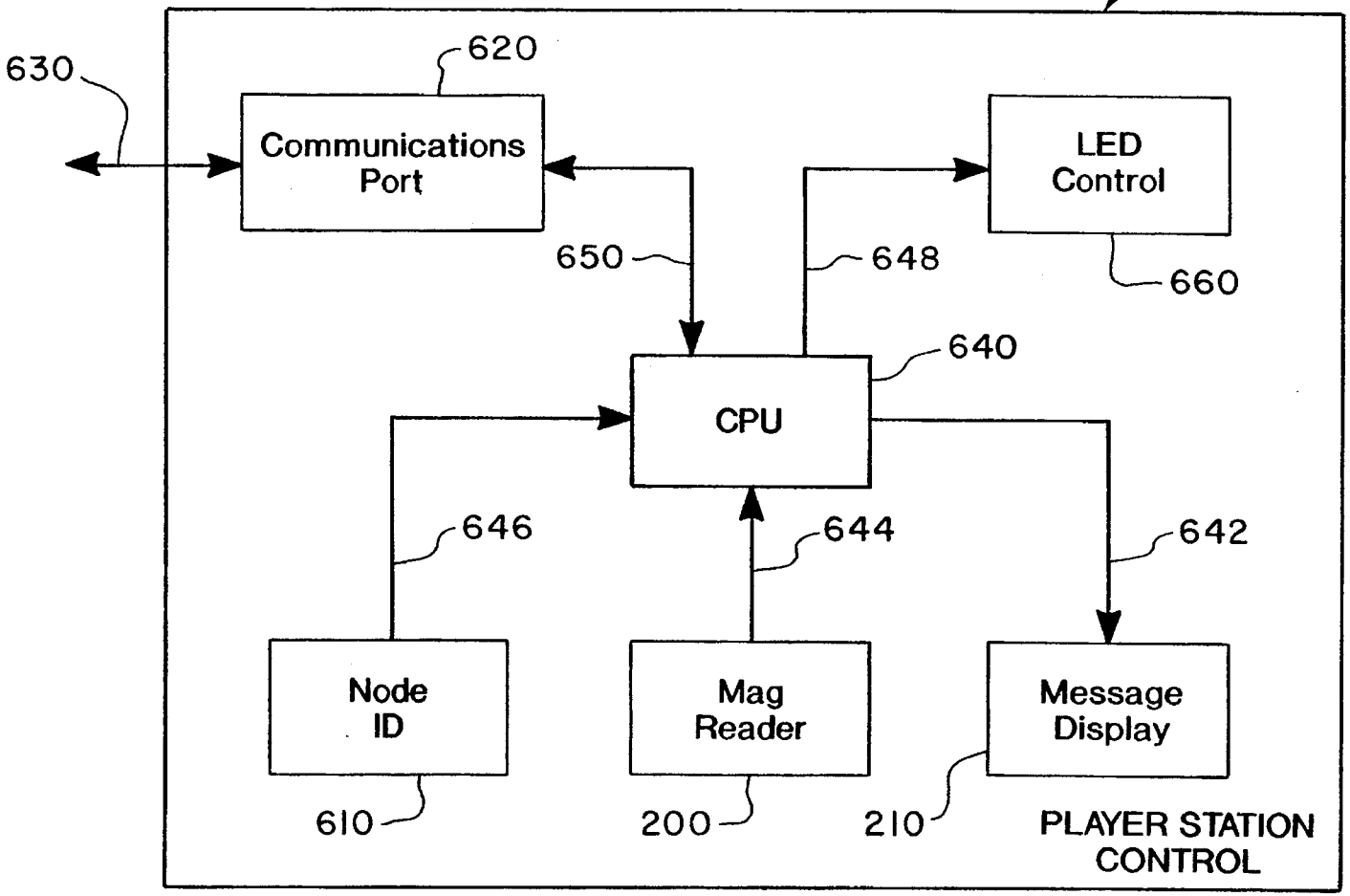
FIG. 6 sets forth the details of player station control electronics of the present invention.

In FIG. 6, the components of the player station control 600 are set forth. Each player station 30 has contained therein a player station control 600. In the player station control 600, a conventional magnetic stripe reader 200 is used such as a Neuron Model MCR-9X1-1R-0101 or its equivalent. A two-way light-emitting diode (LED) 660 is also used. Finally, a message display 210 suitably displays messages to the player at the station 30. In the preferred embodiment, the message display 210 is a conventional model SC055103. The display can state any suitable message 212 such as: WELCOME TO CASINO MR. SMITH! If the player identity card 300 is inserted in the wrong direction, the message can read: PLEASE INSERT CARD CORRECTLY.

Also located at the player station control 600 is a node ID 610 that is mechanically set at installation and that identifies the player position 20 (e.g., position 3). As mentioned, there are typically seven player positions 20 in a conventional table. The node ID 610 is a simple mechanical switching device that can be suitably set to issue an identity signal.

Also found in the player station control 600 is an external communications port 620. In the preferred embodiment, this is a conventional RS/485 communications port that interconnects with a conventional telephone line 630.

In the preferred embodiment, the CPU 640 is a Phillips Model 87C51FB, although it is expressly understood that any suitable microprocessor equivalent could be utilized. The CPU 640 drives the message display 210 over lines 642, reads information from the magnetic reader 200 over bus 644, reads the identity information over lines 646 from the node ID 610, delivers lighting control information over lines 648 to the LED control 660 and provides two-way communication with the port 620 over bus 650.

The phone line 630 is a conventional six-wire phone line with two of the six wires providing ground and +5 volts DC that provides the voltage to the player station control 600. Two of the lines are used for data communication between the port 620 and the CPU 640. The remaining two of the six lines are used for ground isolation around the communication lines. A low voltage of +5 volts is necessary for use in and around gaming table 10.

Figure 7A:
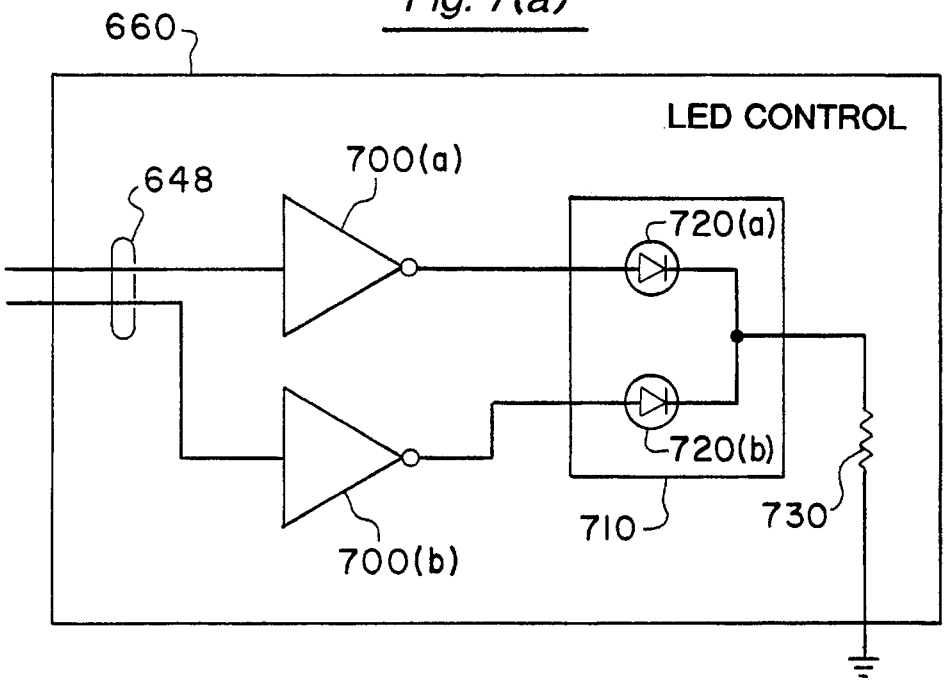
FIG. 7(*a*) sets forth the details of the LED control.
Figure 7B:
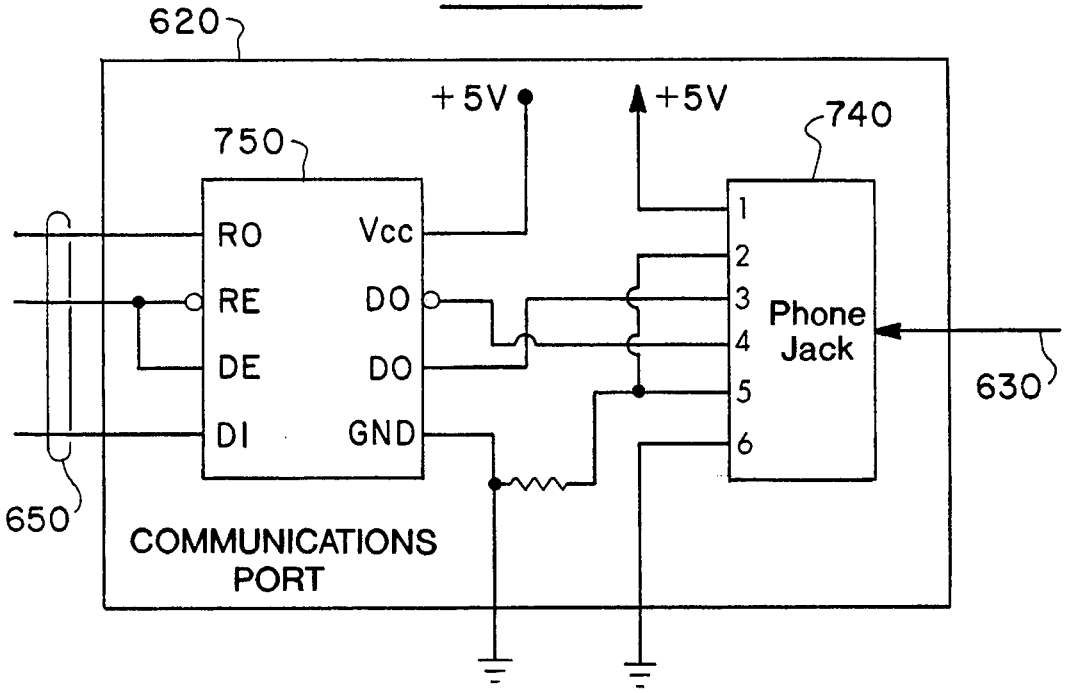

In FIG. 7(*a*), the details of the LED control 660 are shown. The LED control 660 includes two operational amplifiers 700(*a*) and 700(*b*) that drive a two-color LED 710. The first LED 720(*a*) is red and the second LED 720(*b*) is green, in the preferred embodiment. The LEDs 720(*a*) and 720(*b*) are tied through a resistor 730 to ground. In use, the LED is initially RED while the player station control 600 is idle. When the player inserts his card 300 into the reader 200, the light turns GREEN; when the card is not inserted, the light is RED. Any suitable color scheme could be utilized In FIG. 7(*b*), the details of the external communications port 620 are shown. The phone line 630 engages a conventional phone jack 740. The output of the six wires (lines 1—6) from the phone jack 740 are shown to provide power (line 1) and ground (line 6) with lines 2 and 5 providing ground shielding to the communication lines 3 and 4. These lines then interconnect with a standard interface chip 750 that, in the preferred embodiment, is a model DS75176—a standard chip for an RS/485 communications port.

The circuitry in FIGS. 6 and 7 is that of the preferred embodiment and it is to be expressly understood that any circuitry performing the functions described therein could suitably work. The player station control 600 functions to read a magnetic card stripe 340 containing information about a particular player, has the ability to display a message in display 210, has the ability to convey visual control signals in LED 200, and provides an identification for the station from Node ID 610. However, rather than a visual LED signal, an audible signal or a combination of audible and visual signals could be utilized. A different type of communications line as opposed to a telephone line could also be utilized. These and other changes and modifications which could be made to the player station control 600 without parting from the spirit of the invention as set forth in the appended claims.

6. Central Distribution Control

Figure 8:
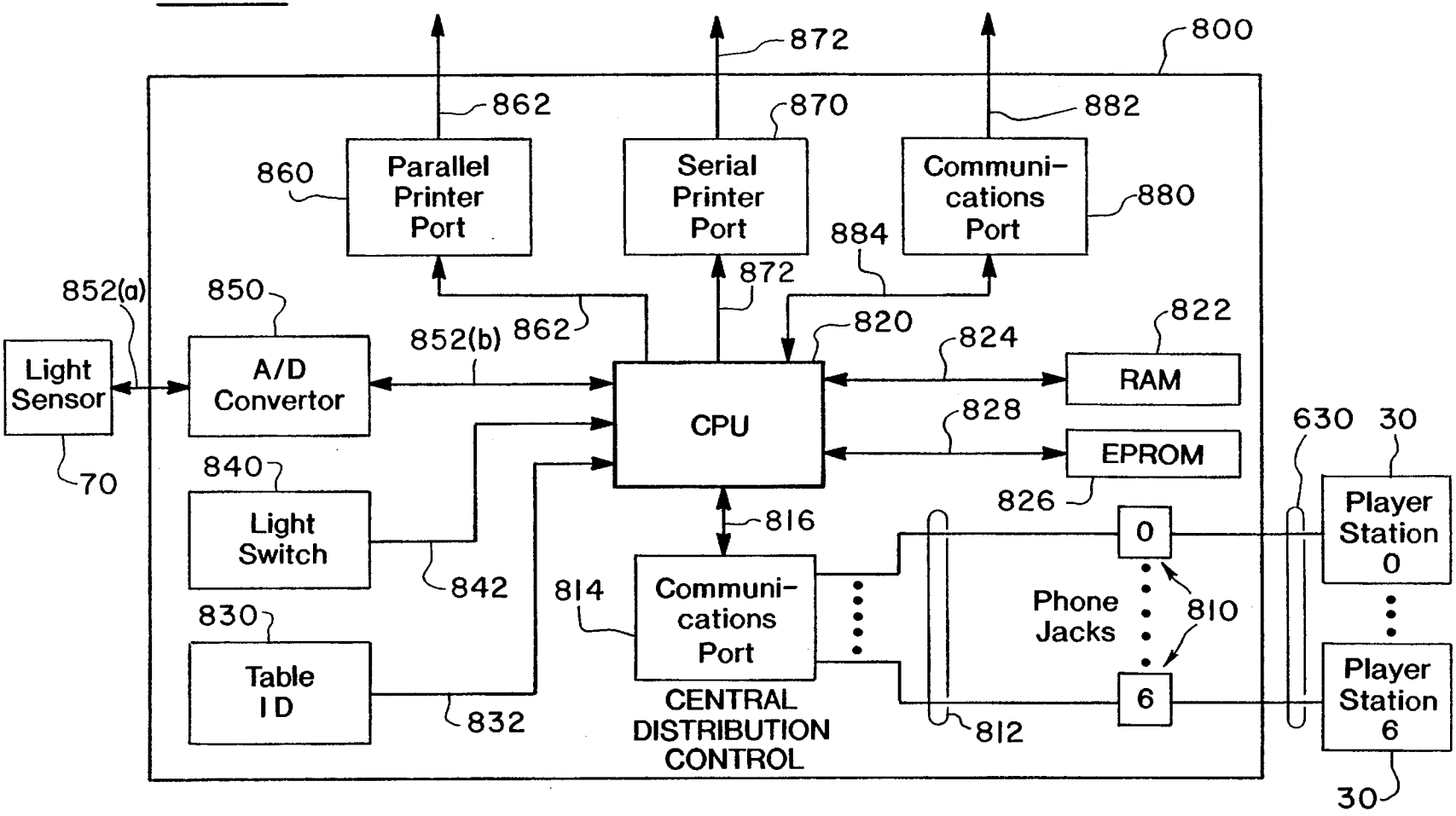
FIG. 8 sets forth the details of the central distribution control of the present invention.

In FIG. 8, the configuration of the central distribution control 800 of the present invention is set forth. Each table 10 has a central distribution control 800 that functions to communicate to each player station 30. Hence, each distribution control 800 has a set of phone jacks 810, with each phone jack communicating over a separate phone line 630 to a unique player station 30. As mentioned in the preferred embodiment, seven player stations exist on a given table, and therefore, seven jacks and seven phone lines 630 would be provided. Each phone jack 810 is connected over lines 812 to a communications port 814.

The central distribution control 800 is controlled by a central processing unit (CPU) 820 that, in the preferred embodiment, is a model 80C320. It is to be expressly understood that any suitable CPU or microprocessor could be used under the teachings of the present invention. The CPU 820 is connected to a random access memory (RAM) 822 over lines 824 and to an electrically programmable read only memory (EPROM) 826 over lines 828. In the preferred embodiment, the RAM 822 is preferably a model MTSC2568 and the EPROM 826 is preferably a model 27C256. These memories are conventionally available.

Each central distribution control 800 also has a table ID circuit 830 that, like the node ID circuit 610, is a mechanical switch arrangement identifying the table 10. As will be explained in more detail subsequently, the present invention contemplates a system arrangement with a plurality of tables 10. In the preferred embodiment, up to 32 tables 10 could be utilized, and therefore, the table ID circuit 830 provides a unique identification for each of the 32 tables. In the preferred embodiment, the table ID circuit 830 delivers a coded signal over lines 832 to the CPU 820 identifying the table 10. The table ID circuit 830 is set upon installation.

A light switch circuit 840 is also found on the central distribution control 800. The ambient light surrounding a given table 10 at a casino varies from location to location. At installation the light switch circuit 840 is set appropriately so as to configure the central distribution control 800 for the ambient light. As will be explained subsequently, this is necessary to adjust the sensitivity of the central distribution control 800 for the light or game sensor 70. Again, control signals are delivered by the light switch circuitry 840 over lines 842 to the CPU 820.

Analog to digital (ND) converter 850 is provided on the central distribution control 800. The ND converter 850 is connected over lines 852(*a*) to the light or game sensor 70. In the preferred embodiment, the light or game sensor 70 is a light-sensitive photocell.

The AD converter 850 is preferably a model ADCO848 circuit that is responsive to the analog signals delivered from the light sensor 70 over lines 852*a* for providing digital signals over lines 852*b* to the CPU 820. The CPU 820, based on the mechanical switch settings in the light switch circuitry 840, adjusts the sensitivity of the light sensor 70 and the A/D converter 850 by setting a level in the A/D converter 850 for triggering based on a voltage comparison with the input from the light sensor 70. In darker environments, the A/D converter 850 is adjusted to be more sensitive, whereas in bright ambient conditions, the ND converter 850 is adjusted to be less sensitive.

It is to be understood that any conventional sensor could be used and that it does not have to be located in the dealer's area. For example, a separate switch, such as a touch pad, could be provided on the table so that whenever the dealer deals, the switch is tapped first and tapped again upon pick-up of the cards.

The CPU 820 conventionally interconnects to a parallel printer port 860 over lines 862 and to a serial printer port 870 over lines 872 and to a communications port 880 over lines 884. Again, in the preferred embodiment, the communications port 880 is an RS/485 port.

Finally, the CPU 820 communicates with a host computer through communications port 880 over bus 882 as also shown in FIG. 1.

It is to be expressly understood that while a preferred embodiment for the distribution control 800 has been shown, changes and/or modifications could be made, under the teachings of the present invention as set forth in the appended claims, by one skilled in the art. Functionally, the distribution control 800 has its own unique table identifier in circuitry 830, has the ability to sense beginning of game and end of game occurrences through light sensor 70, and has the ability to compensate for ambient lighting conditions with light switch circuitry 840. It is to be understood that while light switch circuitry 840 is set upon installation, a second photocell could be utilized instead of the light switch circuitry 840 to continually monitor the ambient light so as to provide feedback to automatically adjust the sensitivity of the light sensor 70.

7. System Arrangement

Figure 9:
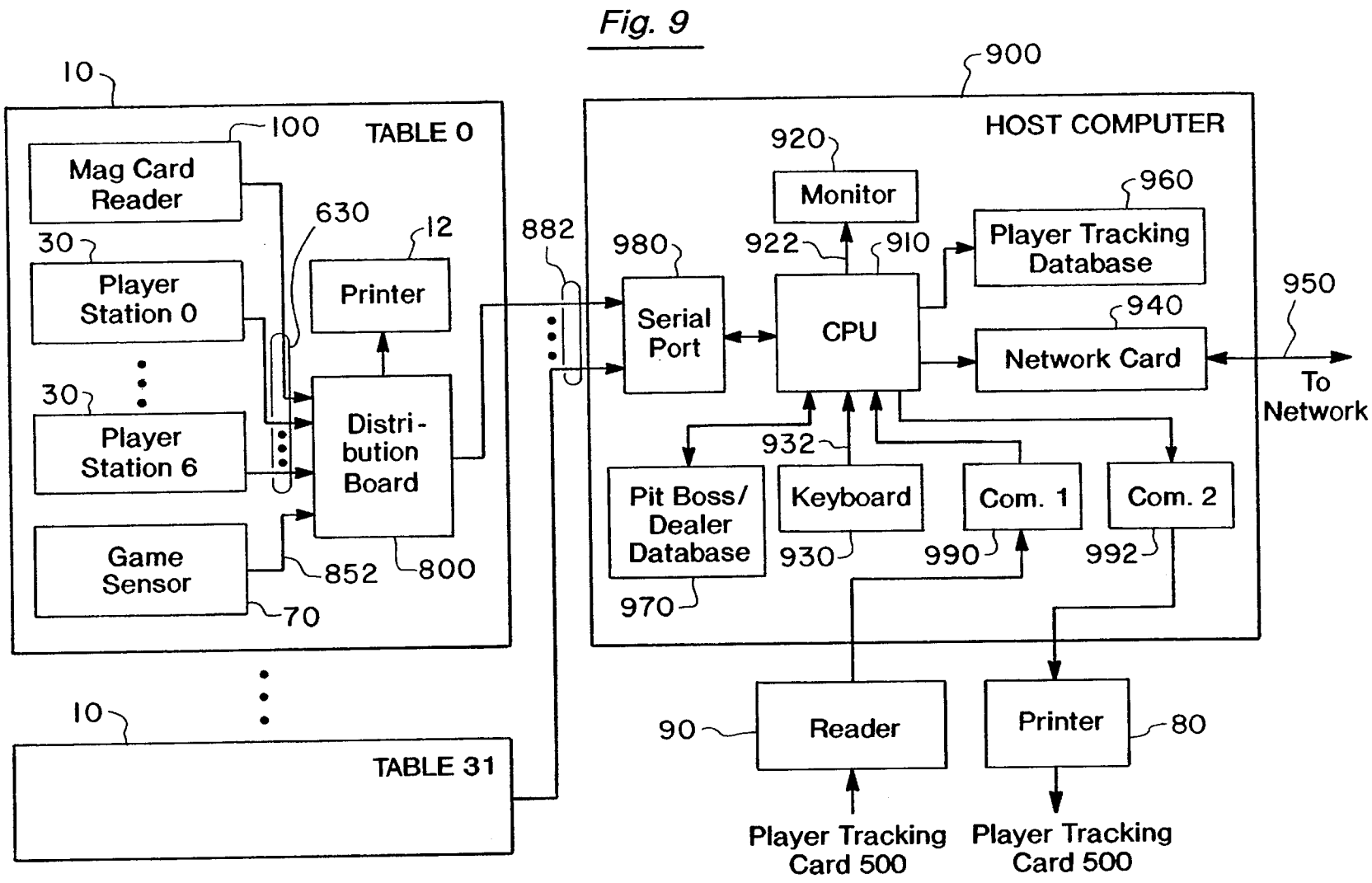
FIG. 9 sets forth the details of the host computer of the present invention interconnected to a plurality of automated player tracking tables.

In FIG. 9, the system arrangement of the present invention is set forth for the environment of 32 separate gaming tables 10. Each gaming table 10 has its own central distribution control 800 that is interconnected to the seven player stations 30, the game sensor 70, printer 12, and the floor supervisor (and/or dealer) magnetic card reader 100. The central distribution control 800 from each table 10 is interconnected over lines 882, which in the preferred embodiment are individual phone lines to the host computer 900 of the present invention. The host computer 900 is comprised of a central processing unit (CPU) 910, which in the preferred embodiment can be any conventional personal computer (PC) processing system. The CPU 910 is connected over lines 922 to a conventional monitor 920 and over lines 932 to a conventional keyboard. The CPU 910, likewise, can be connected through a network card 940 to a conventional network 950. Typically, the host computer 900 of the present invention is located in the floor area of a casino and is responsible for a predetermined number of gaming tables, such as 32. The host computer can be interconnected over the network 950 to a remote computer that contains data files on the casino and greater processing power. The CPU 910 is also connected to a player tracking data base 960 that contains information on a player being tracked by the system of the present invention. The CPU 910 is also connected to a floor boss/dealer data base 970 that maintains a data base on the floor supervisor and/or dealer. Finally, the CPU 910 is connected through a serial port 980 to the central distribution control 800. In a conventional fashion, the CPU 910 can address each table 10 to download information from the central distribution control 800 of each table 10 for storage in its player tracking data base 960 or its floor boss/dealer data base 970.

Finally, the CPU 910 through communication port 990 can read a player tracking card 500 using tracking card reader 90 or through communication port 992 can print a player tracking card 500 using tracking card printer 80 (as shown in FIG. 1).

8. Player Tracking Data Base

Figure 10A:
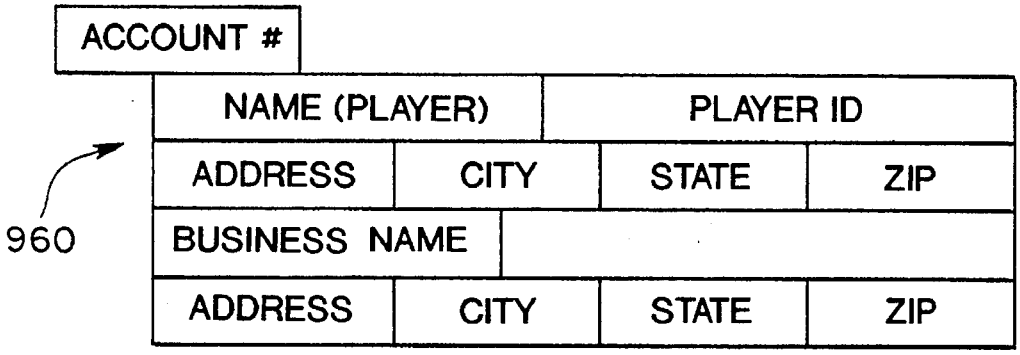
FIG. 10 sets forth the fields of the player tracking data base and the dealer data base.
Figure 10B:
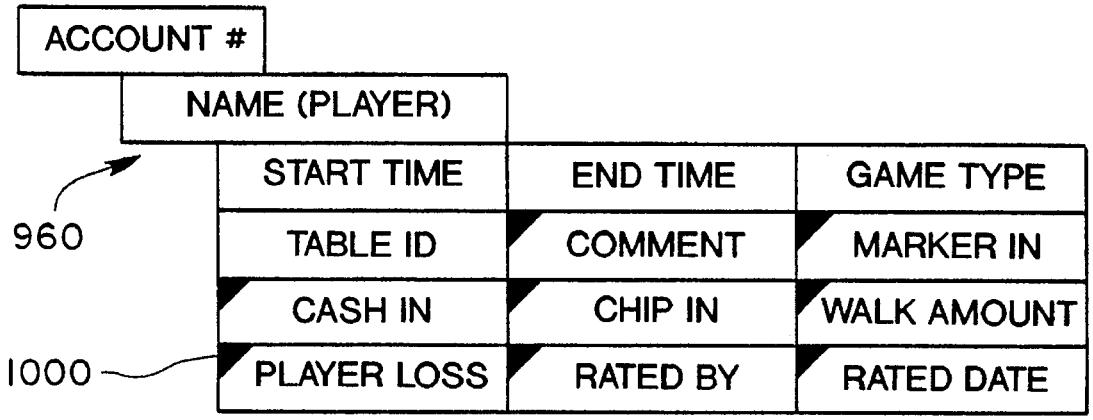
Figure 10C:
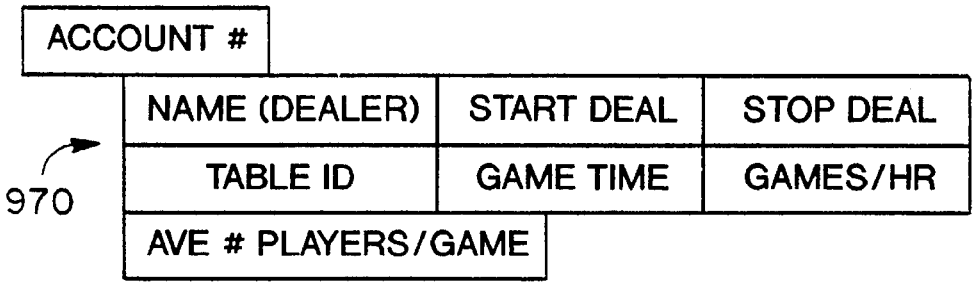

In FIG. 10, the details of the player tracking data base 960 are set forth in FIGS. 10(*a*) and 10(*b*), and the dealer data base 970 is set forth in FIG. 10(*c*).

In FIG. 10(*a*), the player tracking data base 960 contains the following player information. Under the unique account number, the name of the player, the player ID, the address, city, and state, and zip code of the player are set forth. Furthermore, if the player is with a business, the name of the business, address, city, and state, and zip code are also provided. This is the information that is read from the magnetic strip 340 of the player identity card 300. This is also the information that is used to print the corresponding blanks on the player tracking card 500 shown in FIG. 5.

In FIG. 10(*b*), under the same account name and the same name of the player, in-session (i.e., while the player sits at the player position), the following information is obtained:

(1) Staff Time. This is the time that the player inserted card 300 into the card reader 200, thereupon commencing to play the game.

(2) End Time. This is when the player leaves the table by removing his player identity card 300. Please note in FIG. 5(*a*) a box entitled "adjusted end-time" wherein an oval denoted SLOW can be selectively filled in by the floor supervisor should the player stop playing the game, but remain seated at the table without pulling his card 300.

(3) Game Type. This is the identity of the type of game such as blackjack.

(4) Table ID. The identification of the table that is derived from table ID circuit 830 of FIG. 8.

(5) Comment. A field for codes created to categorize gaming traits of the player.

(6) Marker In and Cash In. This is filled in by the floor supervisor as he observes the player. The floor supervisor fills this information in areas 552 and 554 of the tracker card in FIG. 5(*b*).

(7) Chip In. This is the same as above, but for field 556 of the player tracking card 500.

(8) Walking Out. This is field 588, which is an estimated amount of money that the player walks away with after leaving the table.

(9) Player Loss. This is the win, loss, and even ovals in field 558 of the player tracking card and indicates the player's performance while playing at this gaming table.

(10) Rated By. This is the identity of the floor supervisor.

(11) Rated Date. This is the date the player played the game at the gaming table.

Those fields marked with a darkened corner 1000 are in-session gaming information from the player tracker tracking card 500 when it is read by the reader 90 after being filled in by the floor supervisor. It is to be understood that other information, such as the name of the dealer, the shift, and so forth, could also be entered.

In FIG. 10(*c*), an example of a dealer data base 970 is shown. These fields include the account number, which is unique for the dealer, the name of the dealer, the time the dealer started dealing, and the time the dealer stopped dealing. This is obtained by the dealer using the dealer identity card in the reader 100. The identity of the table 10 is also provided. The system of the present invention then determines the game time, which corresponds to the length of time that the dealer dealt game cards at the table. It determines the number of games per hour by monitoring sensor 70. This will be described in more detail next. Furthermore, it determines who at the table is using player identity cards 300 to calculate an average number of players per game. It is important to note that this provides important information to the casino on the dealer's performance.

9. Operation of Game Sensor.

Figure 11:
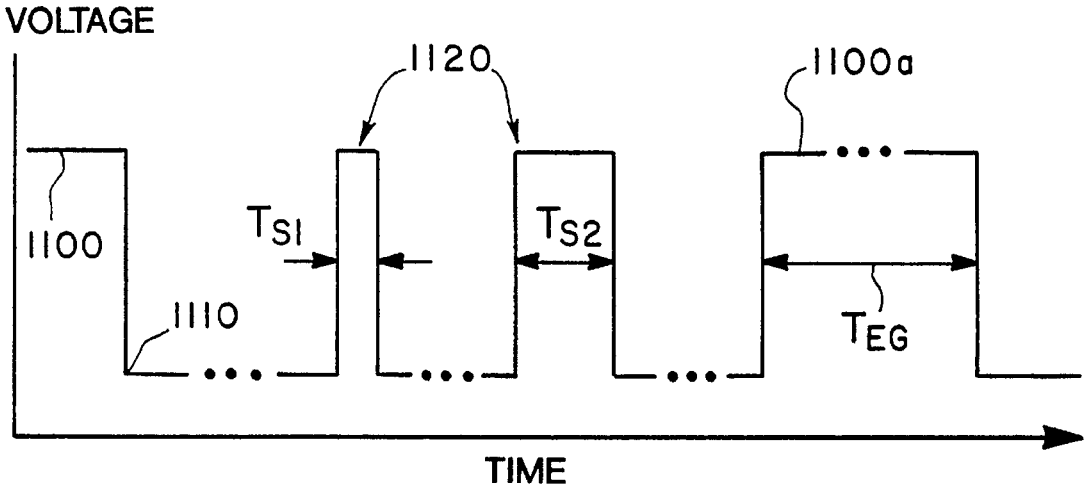
FIG. 11 sets forth the game start and game end timing.

In FIG. 11, the operation of the game sensor 70 of the present invention is illustrated. When no gaming card 130 is placed over the sensor 70 of FIG. 1, the sensor output will be at a first level 1100. This level 1100 indicates the presence of ambient light. When a card 130 is placed over the sensor 70, the ambient light is blocked and the output of the sensor drops to level 1110. As long as a card 130 stays over the sensor 70, the output remains at 1110. It is entirely possible that gaming card 130 is removed from over the sensor 70 during the play of a game, such as when the dealer flips over the gaming card to show the player the value of his hand. In that event, spikes, such as illustrated as 1120, could be generated. When the game is over, the dealer removes the gaming card 130 from over the sensor 70 and level 1100 is returned to as shown by 1100*a*. Under the teachings of the present invention, when level 1100*a* exists for a period of time $T_{eg}$, which stands for the time for end-of-game, the system determines that this is a legitimate time interval between games. The times for the spike such as $T_{s1}$ and $T_{s2}$ are less than this predetermined time and are ignored. Hence, even though spikes 1120 occur, they are of insufficient time duration to trigger an end-of-game signal. Once the end-of-game time has been determined, the first fall to level 1110 is the start-of-game. In this fashion, the start and end of each game can be determined. In preferred times, a spike 1120 can exist for less than two seconds and the $T_{eg}$ can be three to four seconds. It is to be expressly understood that these times are variable to adapt to the game. It is not uncommon for dealers to achieve a high number of games per hour and it is to be understood that this depends on how many players are at the table. For example, if a full seven players are playing blackjack, perhaps 30 games per hour could be achieved; whereas, if the dealer were dealing to one player, perhaps 40 games per hour could be achieved.

10. Retrofit Capabilities.

The present invention can be easily retrofitted to an existing gaming table by simply removing the padded armrest similar to armrest 110. drilling a hole to receive the sensor 70 in the felt area similar to area, 120, and installing the necessary electronics under the table. The present invention can also comprise original equipment and can be manufactured and installed at a factory.

11. Method of Operation

In the previous sections, a method for tracking players at a gaming table has been set forth. Essentially, this method includes the steps:

(a) providing each player at the table 10 with a player identity card 300 containing player information located in the magnetic stripe 340 corresponding to the name of the player and an identity number, (b) at each player position 20 on the gaming table 10, reading the player information from the player identity card 300, (c) printing a player tracking card 500 including all or a portion of the player information printed thereon and a unique identity code associated with the player information, (d) sensing when a game is being played on the gaming table with sensor 70, (e) determining, for each player at a player position 20, how many games the player played, (f) reading the player tracking card 500 with in-session information filled in by the floor supervisor based on the player's performance during the time the player was at the gaming table, (g) providing a data base record on each player based on the player information in the player identity card 300 and storing any combination of the player information, in-session gaming information, identity of the player position, identity of the gaming table, and how many games played.

Variations on this method can certainly be made under the teachings of the present invention.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

We claim:

1. An automated gaming table tracking system for a gaming table on which is played a plurality of games for a predetermined type of game, said gaming table including a playing surface, a plurality of player positions, and an operator position, said playing surface having playing areas for the operator and for each of the plurality of player positions, said automated gaming table tracking system comprising:

a sensor located in the playing area of the operator position for sensing when a game is played;

a plurality of player identity cards, each of said player identity cards containing identity information on the player assigned to said player identity card;

a plurality of player station controls, one of said plurality of player station controls located at each of said plurality of player positions, each of said player station controls including:

(a) means for identifying the player position corresponding to the player station control, (b) means for reading said player identity information from said player identity card when the said player identity card is inserted in said reading means, (c) means for displaying a plurality of predetermined messages, (d) means for signaling an indication when said player identity card is inserted in said reading means, (e) means connected to the identifying means, the reading means, the displaying means, and the signaling means for processing the player position, the player identity information, the plurality of predetermined messages, and the indication, and (f) means connected to the processing means for providing external communication to and from said player station control, a central distribution control connected to the external communication providing means of each of said plurality of player station controls, said central distribution control including:

(a) means for identifying the gaming table, (b) first means connected to the sensor for receiving a game-being-played signal, (c) second means connected to the external communication providing means for receiving from each of said plurality of player station controls for at least receiving the player position and the player information for each player control station reading an inserted player identity card, and (d) means connected to the gaming table identifying means and the first and second receiving means for determining the start and end of each of the games and the beginning and termination of play by each player at each player position;

a host computer connected to said central distribution control for storing the player identity information and the player position for each player station control, the start and end of each of the games, and the beginning and termination of play at each player position;

means connected to said host computer for printing a player tracking card for each player having a player identity card inserted into a player station control, including:

(a) the player identity information, (b) blanks for in-session gaming information; and means connected to said host computer for reading each said player tracking card when each said player tracking card has the blank in-session gaming information filled in, said host computer storing said read in-session gaming information corresponding to the player identity information.

2. The automated gaming table tracking system of claim 1 wherein each of said plurality of player identity cards has a magnetic stripe containing at least the assigned player's identity number and name.

3. The automated gaming table tracking system of claim 2 wherein the reading means in each of said player station controls is a magnetic stripe reader.

4. The automated gaming table tracking system of claim 3 wherein said signaling means in each of said player station controls is a light-emitting device having a first color when said player identity card is inserted into said magnetic stripe reader and a second color when uninserted.

5. The automated gaming table tracking system of claim 1 wherein said sensor is a photocell in the playing area of the operator.

6. The automated gaming table tracking system of claim 1 wherein the first receiving means in the central distribution control includes means for adjusting the sensitivity of the sensor for ambient light conditions.

7. The automated gaming table of claim 1 wherein the printing means is a thermal printer.

8. An automated gaming table tracking system for a gaming table on which is played a plurality of games for a predetermined type of game, said gaming table including a playing surface, a plurality of player positions, and an operator position, said playing surface having playing areas for the operator and for each of the plurality of player positions, said automated gaming table tracking system comprising:

a sensor located in the playing area of the operator on the gaming table for sensing the presence of a game card when played by said operator, said sensor issuing a game-being-played signal as long as said game card is played by said operator in said operator player area, said game-being-played signal terminated when said game card is removed by said operator from said operator playing area;

a plurality of player identity cards, each of said player identity cards containing identity information on the player assigned to said player identity card;

a plurality of player station controls on said gaming table, one of said plurality of player station controls located at each of said plurality of player positions, each of said player station controls at least including:

(a) means for identifying the player position on the gaming table corresponding to the player station control, (b) means for reading said player identity information from said player identity card when said one of said plurality of player identity cards is inserted in said reading means, (c) means connected to said identifying means and to said reading means for providing external communication to and from said player station control; and a central distribution control on said gaming table connected to the external communication providing means of each of said plurality of player station controls, each of said central distribution controls control at least including:

(a) first means connected to the sensor for receiving said game-being-played signal, (b) second means connected to the external communication providing means of each said plurality of player station controls for receiving from each of said plurality of player station controls at least the identity of the player position and the player information for each player control station reading an inserted player identity card, (c) means connected to the first and second receiving means for determining the start and end of each of the games from said received game-being-played signal, the beginning and termination of play by each player at each player position when said player identity card is inserted in said reading means and when said player identity card is removed from said reading means and the identity of each player at each player position.

9. The automated gaming table tracking system of claim 8 wherein each of said player identity cards has a magnetic stripe containing at least the assigned player's identity number and name.

10. The automated gaming table tracking system of claim 9 wherein the reading means in each of said player station controls is a magnetic stripe reader.

11. An automated gaming table tracking system for a gaming table on which is played a plurality of games for a predetermined type of game, said gaming table including a playing surface, a plurality of player positions, and an operator position, said playing surface having playing areas for the operator and for each of the plurality of player positions, said automated gaming table tracking system comprising:

a photocell in the playing area of the operator on the gaming table for sensing when a game is played;

a plurality of player identity cards, each of said player identity cards containing identity information on the player assigned to said player identity card;

a plurality of player station controls on said gaming table, one of said plurality of player station controls located at each of said plurality of player positions, each of said player station controls at least including:

(a) means for identifying the player position on the gaming table corresponding to the player station control, (b) means for reading said player identity information from said player identity card when said player identity card is inserted in said reading means, (c) means connected to said identifying means and to said reading means for providing external communication to and from said player station control; and a central distribution control on said gaming table connected to the external communication providing means of each of said plurality of player station controls, each of said central distribution controls control at least including:

(a) first means connected to the photocell for receiving a game-being-played signal, (b) second means connected to the external communication providing means of each said plurality of player station controls for receiving from each of said plurality of player station controls at least the identity of the player position and the player information for each player control station reading an inserted player identity card, (c) means connected to the first and second receiving means for determining the start and end of each of the games, the beginning and termination of play by each player at each player position.

12. An automated gaming table tracking system for a gaming table on which is played a plurality of games for a predetermined type of game, said gaming table including a playing surface, a plurality of player positions, and an operator position, said playing surface having playing areas for the operator and for each of the plurality of player positions, said automated gaming table tracking system comprising:

a sensor located in the playing area of the operator for sensing the presence of a game card when played by said operator, said sensor issuing a game-being-played signal as long as said game card is played by said operator in said operator playing area, said game-being-played signal terminated when said game card is removed by said operator from said operator playing area;

a plurality of player identity cards, each of said player identity cards containing identity information on the player assigned to said player identity card;

a plurality of player station controls, one of said plurality of player station controls located at each of said plurality of player positions, each of said player station controls at least including:

(a) means for identifying the player position corresponding to the player station control, (b) means for reading said player identity information from said player identity card when said player identity card is inserted in said reading means, (c) means for providing external communication to and from said player stations control; and a central distribution control connected to the external communication providing means of each of said plurality of player station controls, said central distribution control at least including:

(a) first means connected to the sensor for receiving said game-being-played signal, the first receiving means further includes including means for adjusting the sensitivity of the sensor for ambient light conditions;

(b) second means connected to the external communication providing means for receiving from each of said plurality of player station controls at least player position and the player information for each player control station reading an inserted player identity card;

(c) means connected to the first and second receiving means for determining the start and end of each of the games from said received game-being-played signal and the beginning and termination of play by each player at each player position when said player identity card is inserted in said reading means and when said player identity card is removed from said reading means.

13. A method for tracking players at a gaming table comprising the steps of:

providing each player with a player identity card containing player information corresponding to the name of the player and an identity number, at each player position on the gaming table, reading the player information from the player identity card, forming a control data base file containing the read player information, the identity of the player position at the gaming table, and the identity of the gaming table, printing a player tracking card including a portion of the player information printed thereon and a unique identity code associated with the player information, sensing when a game is being played on the gaming table, determining for each player at a player position, how many games the player played in response to the aforesaid step of sensing, reading the player tracking card with in-session information based on the player's performance during the time the player was at the gaming table, providing a data base record on each player based on the player information in the player identity card and containing any combination of the player information, in-session information, identity of the player position, identity of the gaming table, and how many games played.

14. An automated gaming table tracking system for a gaming table on which is played a plurality of games for a predetermined type of game, said gaming table including a playing surface, a plurality of player positions, and an operator position, said playing surface having playing areas for the operator and for each of the plurality of player positions, said automated gaming table tracking system comprising:

a sensor located in the playing area of the operator for sensing when a game is played, said sensor detecting an absence of ambient light;

a plurality of player identity cards, each of said player identity cards containing identity information on the player assigned to said player identity card, a plurality of player station controls, one of said plurality of player station controls located at each of said plurality of player positions, each of said player station controls including:

(a) means for identifying the player position corresponding to the player station control, (b) means for reading said player identity information from a player identity card when the aforesaid player identity card is inserted in said reading means, (c) means for providing external communication to and from said player station control, a central distribution control connected to the external communication providing means of each of said plurality of player station controls, said central distribution control at least including:

(a) first means connected to the sensor for receiving a game-being-played signal, (b) second means connected to the external communication providing means for receiving from each of said plurality of player station controls at least the player position and the player information for each player control station reading an inserted player identity card, (c) means connected to the first and second receiving means for determining the start and end of each of the games and the beginning and termination of play by each player at each player position.

15. The automated gaming table tracking system of claim 14 wherein each of said player identity cards has a magnetic stripe containing at least the assigned player's identity number and name.

16. The automated gaming table tracking system of claim 15 wherein the reading means in each of said player station controls is a magnetic stripe reader.

17. The automated gaming table tracking system of claim 14 wherein said sensor is a photocell in the playing area of the operator.

18. The automated gaming table tracking system of claim 14 wherein the first receiving means in the central distribution control includes means for adjusting the sensitivity of the sensor for ambient light conditions.

19. An automated gaming table tracking system for a live card game, said automated gaming table tracking system for a live card game comprising:

a gaming table, said game gaming table including a playing surface, a plurality of player positions, and an operator position, said playing surface having live card playing areas for the operator and for each of the plurality of player positions, a sensor in the playing area of the operator on the gaming table for sensing the presence of a game card when played by said operator, said sensor issuing a game-being-played signal as long as said game card is played by said operator in said operator playing area, said game-being-played signal terminated when said game is removed by said operator from said operator playing area;

a plurality of player identity cards, each of said player identity cards containing identity information on the player assigned to said player identity card;

a plurality of player station controls on said gaming table, one of said plurality of player station controls located at each of said plurality of player positions, each of said player station controls at least including:

(a) means for identifying the player position on the gaming table corresponding to the player station control, (b) means for reading said player identity information from said player identity card when said player identity card is inserted in said reading means, (c) means connected to said identifying means and to said reading means for providing external communication to and from said player station control; and a central distribution control on said gaming table connected to the external communication providing means of each of said plurality of player station controls, each of said central distribution controls control at least including:

(a) first means connected to the sensor for receiving said game-being-played signal, (b) second means connected to the external communication providing means of each said plurality of player station controls for receiving from each of said plurality of player station controls at least the identity of the player position and the player information for each player control station reading an inserted player identity card, (c) means connected to the first and second receiving means for determining the start and end of each of the live card games from said received game-being-played signal, the beginning and termination of play by each player at each player position.

* * * * *